US007569784B2

(12) United States Patent
Rakus et al.

(10) Patent No.: US 7,569,784 B2
(45) Date of Patent: Aug. 4, 2009

(54) ELECTRICAL SWITCHING APPARATUS, AND HOUSING AND INTEGRAL POLE SHAFT BEARING ASSEMBLY THEREFOR

(75) Inventors: Paul R. Rakus, Beaver Falls, PA (US); David M. Olszewski, Coraopolis, PA (US); Nathan J. Weister, Darlington, PA (US)

(73) Assignee: Eaton Corporation, Cleveland, OH (US)

( * ) Notice: Subject to any disclaimer, the term of this patent is extended or adjusted under 35 U.S.C. 154(b) by 265 days.

(21) Appl. No.: 11/549,294

(22) Filed: Oct. 13, 2006

(65) Prior Publication Data

US 2008/0087535 A1 Apr. 17, 2008

(51) Int. Cl.
*H01H 77/00* (2006.01)

(52) U.S. Cl. ..... 200/244; 335/16; 218/22

(58) Field of Classification Search ..... 200/400, 200/401, 244, 250; 335/15, 16, 190–195, 335/147, 201, 202; 218/15–22, 34, 152–154
See application file for complete search history.

(56) References Cited

U.S. PATENT DOCUMENTS

| | | | | |
|---|---|---|---|---|
| 5,057,806 | A | 10/1991 | McKee et al. | |
| 5,200,724 | A | 4/1993 | Gula et al. | |
| 6,317,019 | B1 | 11/2001 | Herpin et al. | |
| 6,640,363 | B1 * | 11/2003 | Pattee et al. | 5/601 |
| 6,777,636 | B2 * | 8/2004 | Ahlert et al. | 200/401 |

* cited by examiner

*Primary Examiner*—Elvin G Enad
*Assistant Examiner*—Marina Fishman
(74) *Attorney, Agent, or Firm*—Martin J. Moran

(57) ABSTRACT

A bearing assembly is provided for an electrical switching apparatus including a housing having at least one parting line and an exterior side, a stationary contact assembly disposed on one side of the parting line, a movable contact assembly, and an operating mechanism with a pole shaft for moving the movable contact assembly into and out of electrical contact with the stationary contact assembly. The bearing assembly includes a number of primary bearings pivotably supporting the pole shaft on the same side of the parting line as the stationary contact assembly. An integral bearing section including secondary bearings pivotably couples the pole shaft to the housing at least one bearing cover member having a fastening portion. The pole shaft is pivotably disposed at or about the integral bearing section on the exterior side of the housing. A housing and an electrical switching apparatus are also disclosed.

6 Claims, 10 Drawing Sheets

ELECTRICAL SWITCHING APPARATUS, AND HOUSING AND INTEGRAL POLE SHAFT BEARING ASSEMBLY THEREFOR

CROSS-REFERENCE TO RELATED APPLICATIONS

This application is related to commonly assigned, concurrently filed:

U.S. patent application Ser. No. 11/549,316, filed Oct. 13, 2006, entitled "ELECTRICAL SWITCHING APPARATUS, AND CARRIER ASSEMBLY AND INDEPENDENT PIVOT ASSEMBLY THEREFOR";

U.S. patent application Ser. No. 11/549,309, filed Oct. 13, 2006, entitled "ELECTRICAL SWITCHING APPARATUS, AND MOVABLE CONTACT ASSEMBLY AND CONTACT SPRING ASSEMBLY THEREFOR"; and U.S. patent application Ser. No. 11/549,277, filed Oct. 13, 2006, entitled "ELECTRICAL SWITCHING APPARATUS, AND CONDUCTOR ASSEMBLY, AND INDEPENDENT FLEXIBLE CONDUCTIVE ELEMENTS THEREFOR", all of which are hereby incorporated herein by reference.

BACKGROUND OF THE INVENTION

1. Field of the Invention

The invention relates generally to electrical switching apparatus and, more particularly, to an electrical switching apparatus, such as a circuit breaker having a housing and a pole shaft bearing assembly. The invention also relates to housings for circuit breakers. The invention further relates to pole shaft bearing assemblies for circuit breakers.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions.

Many low-voltage circuit breakers, for example, employ a molded housing having two parts, a first half or front part (e.g., a molded cover), and a second half or rear part (e.g., a molded base). The operating mechanism for such circuit breakers is often mounted to the front part of the housing, and typically includes an operating handle and/or button(s) which, at one end, is (are) accessible from the exterior of the molded housing and, at the other end, is (are) coupled to a pivotable pole shaft. Electrical contact assemblies, which are also disposed within the molded housing, generally comprise a conductor assembly including a movable contact assembly having a plurality of movable contacts, and a stationary contact assembly having a plurality of corresponding stationary contacts. The movable contact assembly is electrically connected to a generally rigid conductor of the conductor assembly by flexible conductors, commonly referred to as shunts. The movable contact assembly includes a plurality of movable contact arms or fingers, each carrying one of the movable contacts and being pivotably coupled to a contact arm carrier. The contact arm carrier is pivoted by a protrusion or arm on the pole shaft of the circuit breaker operating mechanism to move the movable contacts into and out of electrical contact with the corresponding stationary contacts of the stationary contact assembly. The contact arm carrier includes a contact spring assembly structured to bias the fingers of the movable contact assembly against the stationary contacts of the stationary contact assembly in order to provide and maintain contact pressure when the circuit breaker is closed, and to accommodate wear.

Each of the components of the circuit breaker, including the two parts or halves (e.g., the molded cover and the molded base) of the circuit breaker housing, is subject to dimensional variation during manufacturing. Specifically, molded components, such as the molded cover and molded base, have a parting line which is created as part of the molding process, and which results in one portion (e.g., the exterior side) varying in dimension with respect to another portion (e.g., the interior side) of the same component. Such variations are also cumulative when the parts are assembled. For example, as previously noted, the operating mechanism of known low-voltage circuit breakers is mounted to the front part of the housing, which in turn is coupled to the rear part of the housing to which the stationary contact assembly is coupled. Thus, the parts are connected or "stacked" in series. Variations among the parts within the series add up, resulting in an undesirable reduction of the accuracy of the relationship (i.e., alignment) between parts across the stack.

The two separate half structures of the circuit breaker molded housing are particularly susceptible to misalignment. Specifically, variations across the parting line (the line designating the two halves of the mold used to make the component) as well as variations across the mating line or lines between components in the stack, result in misalignment between, for example, the stationary contact assembly and the pole shaft of the operating mechanism, thus inhibiting circuit breaker performance. The accuracy with which the components of the circuit breaker are mounted with respect to one another significantly affects the kinematics of the circuit breaker, and the predictable and thus repeatable mechanical, electrical and thermal performance of the circuit breaker. Accordingly, there is a need for a cost-effective circuit breaker design structured to reduce the aggregate dimensional variation among components of the circuit breaker.

It is known that the effects of dimensional variations between circuit breaker components such as, for example, between the stationary contact assembly and the operating mechanism and pole shaft, can, in large part, be minimized by reducing manufacturing tolerances. However, this approach would significantly increase manufacturing cost.

There is, therefore, room for improvement electrical switching apparatus, such as low-voltage circuit breakers, and in housings for circuit breakers and in mounting assemblies for circuit breaker components.

SUMMARY OF THE INVENTION

These needs and others are met by embodiments of the invention, which are directed to a molded housing for an electrical switching apparatus, such as a low-voltage circuit breaker, having an integral pole shaft bearing assembly structured to minimize the accumulation of manufacturing dimensional variations and undesirable effects associated with the same.

As one aspect of the invention, a bearing assembly is provided for an electrical switching apparatus including a housing having at least one parting line and an exterior side, a stationary contact assembly disposed on one side of the parting line, a movable contact assembly, and an operating mechanism. The operating mechanism includes a pole shaft for moving the movable contact assembly into and out of electrical contact with the stationary contact assembly. The bearing assembly comprises: a number of primary bearings structured to pivotably support the pole shaft of the operating mechanism on the same side of the parting line as the stationary contact assembly; an integral bearing section structured to pivotably couple the pole shaft of the operating mechanism to the housing of the electrical switching apparatus; and at least one bearing cover member including a bearing surface and a fastening portion structured to be coupled to the exterior side of the housing of the electrical switching apparatus. When the fastening portion of the bearing cover member is coupled to the exterior side of the housing, the pole shaft of the operating mechanism is pivotably disposed between the integral bearing section and the bearing surface of the bearing cover member on the exterior side of the housing.

The pole shaft of the operating mechanism may be generally cylindrical in shape and the integral bearing section may comprise a plurality of molded portions structured to be molded on the exterior side of the housing of the electrical switching apparatus in order to receive the generally cylindrical pole shaft. The at least one bearing cover member may be a plurality of bearing cover members, wherein the integral bearing section and the bearing cover members combine to form a plurality of secondary pole shaft bearings each having a first part and a second part, and wherein the molded portions of the integral bearing section comprise the first part and the bearing surface of each of the bearing cover members comprises the second part.

As another aspect of the invention, a housing is provided for an electrical switching apparatus including a stationary contact assembly, a movable contact assembly, and an operating mechanism including a pole shaft for moving the movable contact assembly into and out of electrical contact with the stationary contact assembly. The housing comprises: a molded cover having a parting line and an exterior side; a molded base disposed generally opposite from and coupled to the molded cover, the molded base including a parting line and an exterior side, the molded base being structured to receive the stationary contact assembly of the electrical switching apparatus on one side of the parting line of the molded base; and a bearing assembly comprising: a number of primary bearings structured to pivotably support the pole shaft of the operating mechanism of the electrical switching apparatus on the same side of the parting line of the base member as the stationary contact assembly of the electrical switching apparatus, an integral bearing section, and at least one bearing cover member including a bearing surface and a fastening portion, wherein the fastening portion of the at least one bearing cover member couples the at least one bearing cover member to one of the molded cover and the molded base, in order that the pole shaft of the operating mechanism is pivotably disposed between the integral bearing section and the bearing surface of the at least one bearing cover member on the exterior side of the one of the molded cover and the molded base.

The molded cover and the molded base may each further comprise an interior side and a number of substantially vertical walls extending outwardly from the interior side, wherein each of the primary bearings comprises a molded extension of one of the substantially vertical walls of the molded base that couples to a corresponding bearing cover member of the integral bearing section proximate one of the molded portions of the integral bearing section, in order to support the pole shaft of the operating mechanism. The bearing assembly may further comprise a plurality of fasteners wherein the bearing cover members comprise a first molded cover member, a second molded cover member, a third molded cover member, and a fourth molded cover member and wherein at least one of the first molded cover member, the second molded cover member, the third molded cover member, and the fourth molded cover member is coupled to the molded extension of a corresponding one of the substantially vertical walls by at least one of the fasteners. The molded cover and the molded base may be joined at a mating line wherein the pole shaft of the electrical switching apparatus operating mechanism is substantially disposed on the exterior side of one of the molded cover and the molded base of the housing and is substantially pivotably coupled to and supported by the primary bearings of the other one of the molded cover and molded base of the housing, thereby being substantially independent of dimensional and tolerance variations across the mating line.

As another aspect of the invention, an electrical switching apparatus comprises: a stationary contact assembly having a plurality of stationary electrical contacts; a movable contact assembly having a plurality of movable contact arms and a plurality of movable electrical contacts coupled to the movable contact arms; an operating mechanism including a pole shaft for moving the movable contact arms and the movable electrical contacts coupled thereto into and out of electrical contact with the stationary electrical contacts of the stationary contact assembly; and a housing comprising: a molded cover having a parting line and an exterior side, a molded base disposed generally opposite from and coupled to the molded cover, and including a parting line, the stationary contact assembly being disposed on one side of the parting line of the molded base, and a bearing assembly comprising: a number of primary bearings pivotably supporting the pole shaft of the operating mechanism of the electrical switching apparatus on the same side of the parting line of the molded base as the stationary contact assembly of the electrical switching apparatus, an integral bearing section, and at least one bearing cover member including a bearing surface and a fastening portion, wherein the fastening portion of the at least one bearing cover member couples the at least one bearing cover member to one of the molded cover and the molded base, in order that the pole shaft of the operating mechanism is pivotably disposed between the integral bearing section and the bearing surface of the at least one bearing cover member at or about the exterior side of the one of the molded cover and the molded base.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
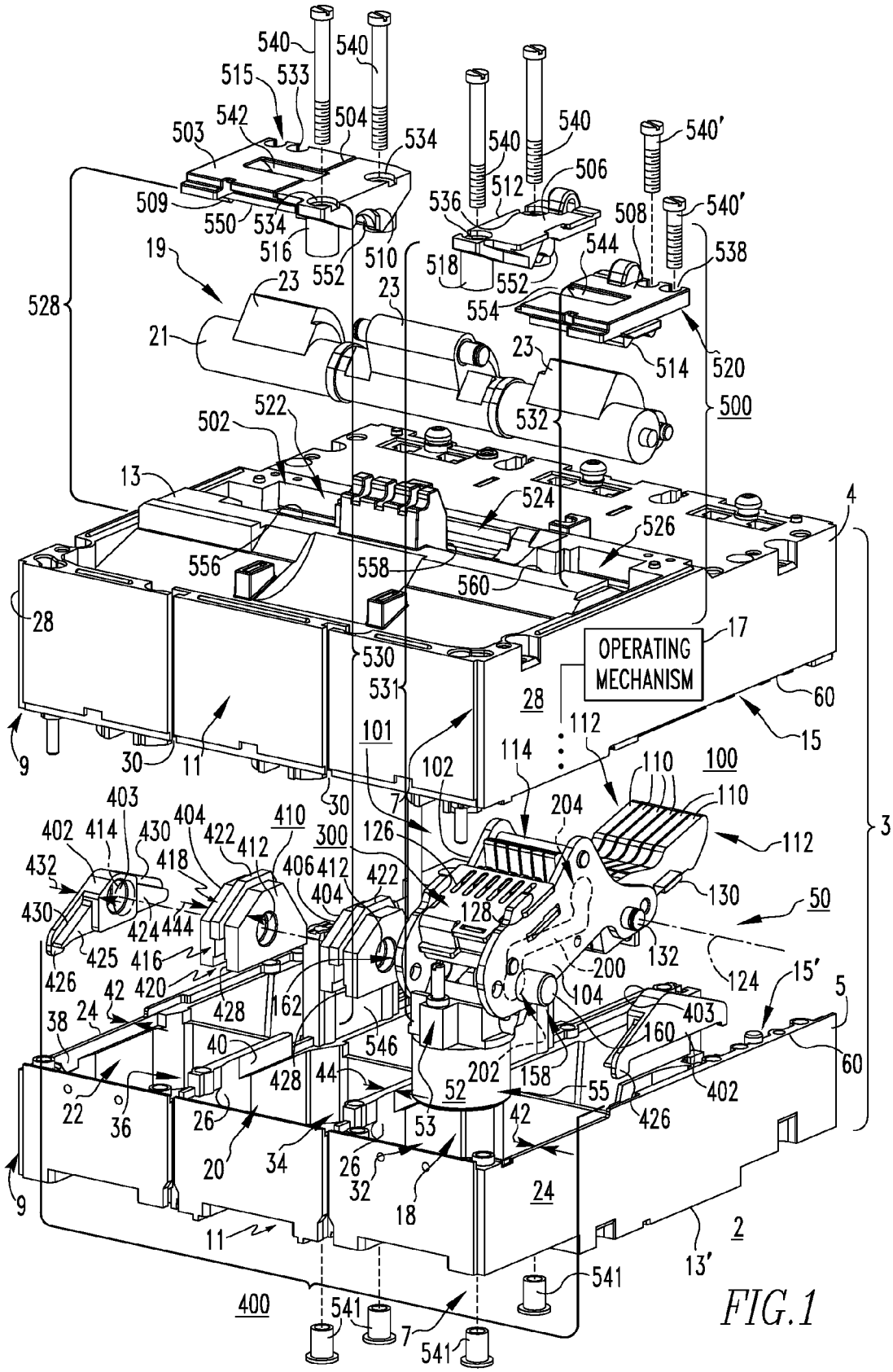
FIG. 1 is an exploded isometric view of a low-voltage circuit breaker and integral pole shaft bearing assembly in accordance with an embodiment of the invention.

For purposes of illustration, embodiments of the invention will be described as applied to the pole shaft bearing assembly of a low-voltage circuit breaker although it will become apparent that they could also be applied to minimize dimensional variations between a variety of different components of any known or suitable electrical switching apparatus (e.g., without limitation, circuit switching devices and circuit interrupters such as circuit breakers, network protectors, contactors, motor starters, motor controllers and other load controllers).

Directional phrases used herein, such as, for example, left, right, clockwise, counterclockwise and derivatives thereof, relate to the orientation of the elements shown in the drawings and are not limiting upon the claims unless expressly recited therein.

As employed herein, the term "parting line" refers to the line which is created between sections of the mold which is used as part of the molding process for producing a molded component such as, for example and without limitation, the molded cover and molded base of the housing of the circuit breaker shown and described herein. Dimensional and tolerance variations occur across the parting line, such that one portion or section of the molded component on one side of the parting line is not in the desired precise orientation with respect to another portion or section on the other side of the parting line. For example and without limitation, the example parting lines discussed herein are defined between the respective interior surfaces or sides and the exterior surfaces or sides of the molded cover and molded base of the circuit breaker housing.

As employed herein, the term "mating line" refers to the junction or interface between two adjacent, separate components such as, for example and without limitation, the mating line defined by the junction of the molded cover of the example circuit breaker housing with the molded base of the circuit breaker housing.

As employed herein, the statement that two or more parts are "coupled" together shall mean that the parts are joined together either directly or joined through one or more intermediate parts.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the term "number" shall mean one or an integer greater than one (i.e., a plurality).

FIG. 1 shows a low-voltage circuit breaker 2 including a housing 3 which encloses a conductor assembly 50 having a movable contact assembly 100 with flexible conductive elements 200 (one flexible element 200 is shown in hidden line drawing in simplified form in FIG. 1), in accordance with embodiments of the invention. The housing 3 includes a first half or front part 4 (e.g., a molded cover) and a second half or back part 5 (e.g., a molded base), with the conductor assembly 50 being disposed therebetween. The low-voltage circuit breaker 2 further includes first and second conductors such as the example line and load conductors 6,8 partially shown in phantom line drawing in simplified form in FIG. 3.

Figure 2:
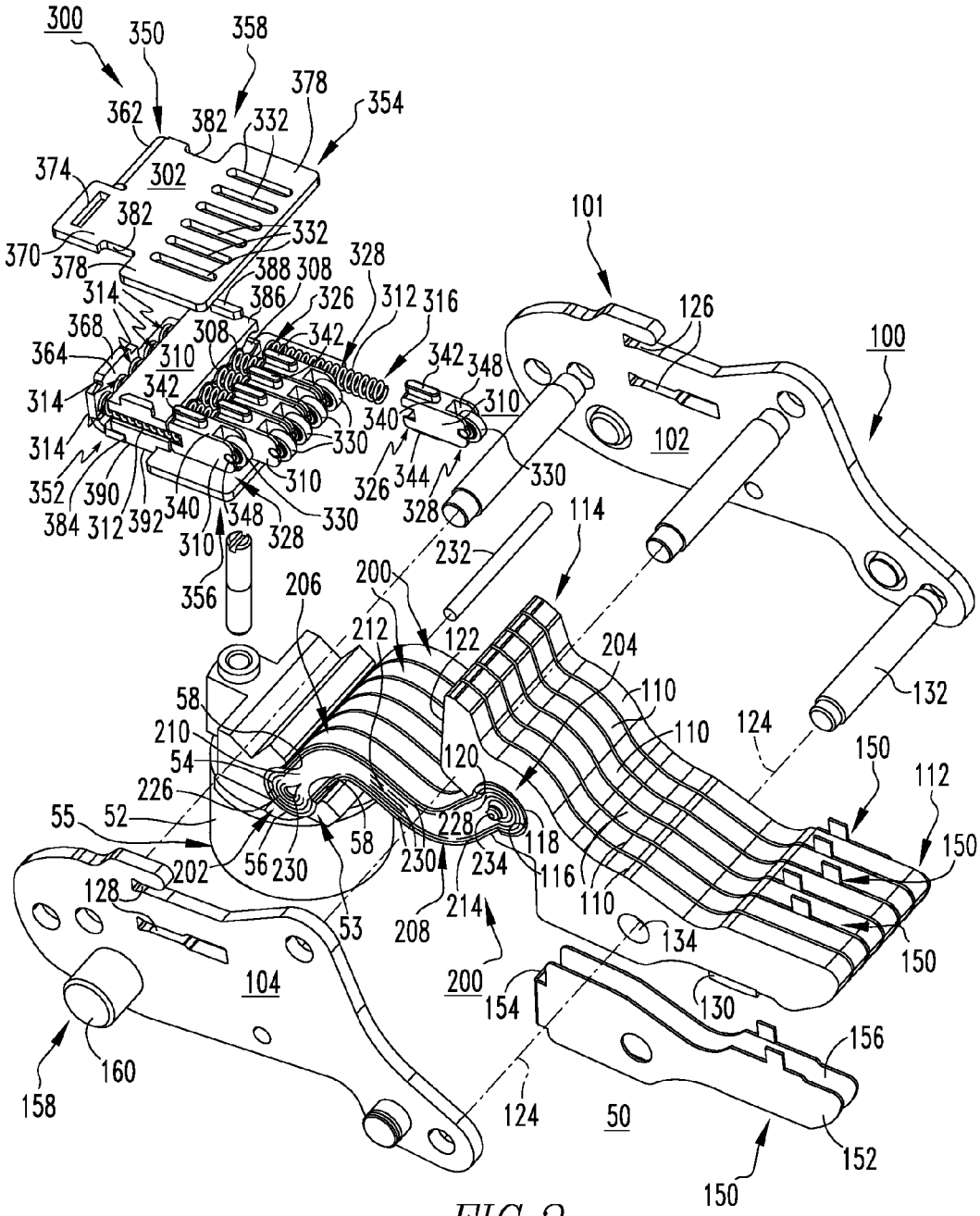
FIG. 2 is an exploded isometric view of the conductor assembly for the low-voltage circuit breaker of FIG. 1.
Figure 3:
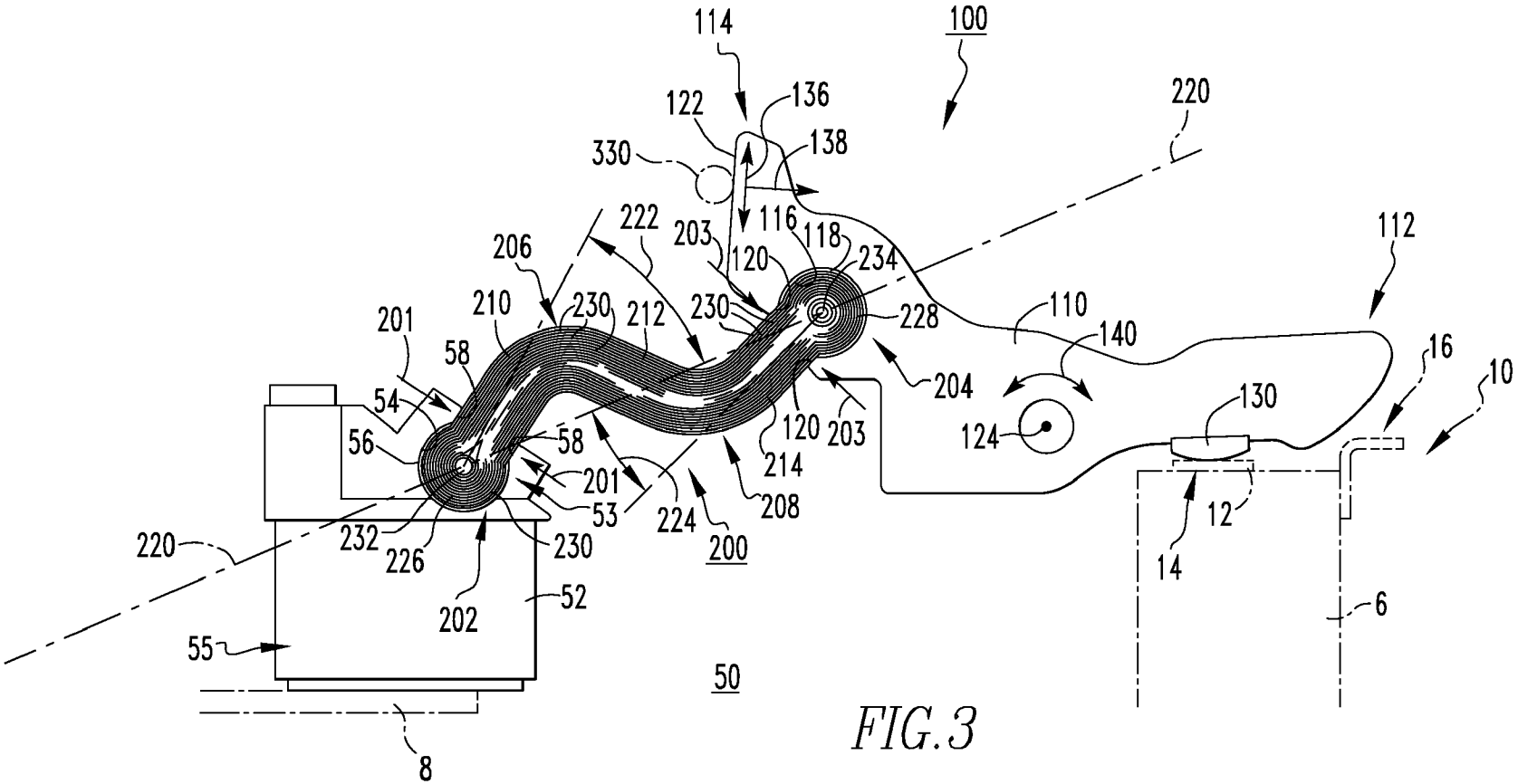
FIG. 3 is a side elevational view of a portion of the conductor assembly of FIG. 2.

As shown in FIGS. 2 and 3, the conductor assembly 50 includes a load conductor 52, a movable contact assembly 100, and a plurality of the flexible conductive elements 200 electrically connecting the load conductor 52 and the movable contact assembly 100. The movable contact assembly 100 includes a plurality of movable contact arms 110. Each of the movable contact arms 110 has a first end 112 and a second end 114. A movable electrical contact 130 is coupled to each movable contact arm 110 at or about the first end 112 thereof, and is structured to move into and out of electrical contact with a corresponding stationary electrical contact 12 (FIG. 3) of the low-voltage circuit breaker 2 (FIG. 1). Specifically, as shown in FIG. 3, the first electrical conductor or line conductor 6 of the circuit breaker 2 (FIG. 1) includes a stationary contact assembly 10 (shown in phantom line drawing in simplified form) having a plurality of stationary electrical contacts 12 (one stationary electrical contact 12 is shown in FIG. 3).

When the conductor assembly 50 is assembled within the circuit breaker housing 3 (FIG. 1) the load conductor 52 is in electrical contact with the second electrical conductor or load conductor 8 of the circuit breaker 2 and the movable electrical contact 130 is movable into (FIG. 3) and out of (not shown) electrical contact with the corresponding stationary electrical contact 12 of the stationary contact assembly 10. It will be appreciated that, for simplicity of illustration, only one conductor assembly 50 is shown in the figures. Typically, however, the low-voltage circuit breaker 2, shown in FIG. 1, which is a three-pole circuit breaker 2, would include three such conductor assemblies 50, one for each of the poles of the circuit breaker 2. It will further be appreciated that the conductor assembly 50 could be employed with any known or suitable electrical switching apparatus having any number of poles other than the three-pole low-voltage circuit breaker 2 shown and described in connection with FIG. 1.

Referring to FIGS. 2 and 3, each of the flexible conductive elements 200 which electrically connect the load conductor 52 of the conductor assembly 50 to the movable contact assembly 100, includes a first end 202 structured to be electrically connected to the load conductor 52, a second end 204 structured to be electrically connected to a corresponding one of the movable contact arms 110 of the movable contact assembly 100, and a plurality of bends 206,208 between the first end 202 and the second end 204. As best shown in FIG. 3, a first one of the bends 206 is in a first direction and at least a second one of the bends 208 is in a second direction which is generally opposite the first direction of the first bend 206. More specifically, the example flexible conductive element 200 is a shunt comprising layered conductive ribbon 230 (shown exaggerated in FIGS. 2 and 3 for ease of illustration), and includes two bends 206,208, a first bend 206 in the first direction, and a second bend 208 in the second direction in order that the shunt 200 is generally S-shaped. Accordingly, the shunt 200 includes a first portion 210 disposed between the first end 202 and the first bend 206, a second portion 212 disposed between first bend 206 and second bend 208, and a third portion 214 disposed between second bend 208 and the second end 204 of the shunt 200. The generally S-shape configuration of the shunt 200 permits it to have a relatively low profile in a vertical direction, thus minimizing the amount of space required for the conductor assembly 50 within the circuit breaker housing 2 (FIG. 1).

An axis 220 extends between the first end 202 of the shunt 200 and the second end 204 of the shunt 200. The first portion 210 of the shunt 200 forms a first angle 222 with respect to axis 220 on one side of the axis, and the third portion 214 of the shunt 200 forms a second angle 224 with respect to the axis 220, on the opposite side of the axis 220. Preferably the first and second angles 222,224 of the first and third portions 210,214 of shunt 200, are different. For example, the first angle 222 of the shunt 200 of FIG. 3 is greater than second angle 224. By way of a non-limiting example, the first angle 222 of the example shunt 200 is between about 26 degrees and about 36 degrees with respect to axis 220, and the second angle 224 is between about 11 degrees and about 22 degrees. It will, however, be appreciated that any known or suitable shunt configuration could be employed in accordance with embodiments of the invention to accommodate the compound motion of the conductor assembly 50 while minimizing areas of stress concentration in the shunts 200 and providing a compact shunt design. It will also be appreciated that while the shunt 200 is contemplated as being made from wound layered conductive ribbon 230 which is made of copper, that any known or suitable electrically conductive material could alternatively be employed without departing from the scope of the invention. Likewise, while the example shunt 200 has about 58 layers of conductive ribbon 230, a width of about 0.35 inches, a length of about 2.2 inches (measured from the center of the first end 202 of shunt 200 to the center of the second end 204 thereof), an overall thickness of about 0.187 inches, and a ribbon layer thickness of about 0.003 inches, it will be appreciated that one or more of these dimensions could be changed to any known or suitable value as necessary for the particular application in which the shunt 200 will be used.

Continuing to refer to FIGS. 2 and 3, the load conductor 52 of the conductor assembly 50 comprises a solid conductor 52 having a first portion 53 and a second portion 55 generally opposite the first portion 53. The first portion 53 includes a first aperture which generally comprises a single elongated recess 54 (best shown in FIG. 2). The single elongated recess 54 receives the first ends 202 of all of the shunts 200. The second ends 204 of the shunts 200 are received in corresponding second apertures 116 in the second ends 114 of each of the movable contact arms 110 (six shunts 200 are shown in FIG. 2). More specifically, the first end 202 of each shunt 200 comprises a first generally round head 226 and the second end 204 of the shunt 200 comprises a second generally round head 228. The single elongated recess 54 of the load conductor 52 and the second aperture 116 of the corresponding movable contact arms 110 each comprise an interior arcuate portion 56,118 and a neck portion 58,120, respectively, as shown. The first generally round head 226 of the first end 202 of shunt 200 is disposed within the interior arcuate portion 56 of the first aperture or single elongated recess 54 of the load conductor 52, as shown, and the neck portion 58 of the first aperture 54 is compressed against shunt 200 in the direction indicated by arrows 201 of FIG. 3 in order to retain the first end 202 of the shunt 200 within the first aperture 54. Similarly, the second generally round head 228 is disposed within the second aperture 116 of the corresponding movable contact arm 110, and the second end 204 of the shunt 200 is retained within the interior arcuate portion 118 of the second aperture 116. Such retention can be provided by the neck portion 120 of the second aperture 116 being compressed against the shunt 200 in the direction generally indicated by arrows 203 of FIG. 3, but may further or alternatively be provided by a pin 234 being inserted through the round head 228 (discussed hereinbelow) and then swaged or peened to expand the layers of conductive ribbon 230 of the second end 204 radially outward against the interior arcuate portion 118 of the second aperture 116.

For each of the example shunts 200, the first and second generally rounds heads 226,228 of the first and second ends 202,204 further include first and second pins 232,234 disposed through the center of the heads 226,228 within the first and second apertures 54,116, respectively. More specifically, the layers of conductive ribbon 230 of the shunt 200 wrap around the first and second pins 232,234 within the first and second apertures 54,116, respectively, of the load conductor 52 and the corresponding movable contact arm 110, respectively, as shown in FIG. 3.

In FIG. 2, the first pin 232 is shown before being inserted through the center of the first generally round head 226 of each of the shunts 200 within the interior arcuate portion 56 of the single elongated recess 54 of the load conductor 52. Accordingly, it will be appreciated that the first and second ends 202,204 of the shunts are secured within the first and second apertures 54,116, respectively, of the load conductor 52 and the corresponding movable contact arms 210. This may be accomplished by, for example and without limitation, swaging or crimping a portion (e.g., neck portion 58) of the load conductor 52 adjacent the first aperture 54, and a portion (e.g., neck portion 120) of the corresponding movable contact arm 110 adjacent the second aperture 116 against the first and second ends 202,204 of the shunts 200, respectively, or by any other known or suitable fastening process or mechanism, such as, for example, a rivet 232,234 (e.g., a staked or suitably deformed pin), solder, brazing, or any suitable combination thereof.

As best shown in FIG. 2, the movable contact assembly 100 may further include a plurality of spacers 150 structured to separate the movable contact arms 110 of the assembly 100 from one another. Specifically, each of the spacers 150 includes a first portion 152, a connection portion 154, and a second portion 156 spaced opposite from the first portion 152, as shown. Each of the movable contact arms 110 of the movable contact assembly 100 is disposed between the first and second portions 152,156 of one of the spacers 150, thereby separating one movable contact arm 110 from at least one other movable contact arm 110 of the movable contact assembly 100. The spacers 150 may be made from any known or suitable material, such as, for example and without limitation, vulcanized fiber material, commonly referred to as fish paper. It will be appreciated that the spacers 150 may, but need not necessarily, also serve to electrically and/or thermally insulate the movable contact arms 110 of the assembly 100 from one another.

In addition to the aforementioned flexible conductive members 200, FIG. 2 also shows a contact spring assembly 300 for the movable contact assembly 100 of conductor assembly 50. The movable contact assembly 100, previously discussed, further includes opposing first and second carrier members 102,104 which secure the movable contact arms 110 therebetween, thus comprising a carrier assembly 101. The contact spring assembly 300 is coupled to at least one of the first and second carrier members 102,104, and is disposed between the first and second carrier members 102,104 proximate the second ends 114 of the movable contact arms 110.

Referring to FIGS. 2, 4, 5, 6A, and 6B, the contact spring assembly 300 includes a first contact spring housing member 302 and a second contact spring housing member 304 coupled to the first contact spring housing member 302 and disposed opposite therefrom. A spring guide 306 is coupled to at least one of the first and second contact spring housing members 302,304, and is disposed therebetween. The spring guide 306 includes a plurality of spring holes 308 each structured to receive a corresponding spring 312. Specifically, each spring 312 has a first end 314, which is received by a corresponding one of the spring holes 308 of spring guide 306, and a second end 316, which is coupled to a corresponding slider 310 (best shown in FIGS. 2 and 5). Each of the springs 312 and sliders 310 coupled thereto is structured to individually bias a corresponding one of the movable contact arms 110 (FIGS. 1-4) of the movable contact assembly 100 (FIGS. 1-4) and the movable electrical contact 130 (FIGS. 1-3) coupled thereto towards engagement with a corresponding one of the stationary electrical contacts 12 (FIG. 3) of the stationary contact assembly 10 (FIG. 3).

The example first and second contact spring housing members 302,304 are substantially identical. Thus, the number of components which must be manufactured for the contact spring assembly 300 is reduced, thereby reducing the associated manufacturing costs. Additionally, the substantially identical first and second contact spring housing members 302,304 enable the contact spring assembly 300 to be secured together without requiring the use of conventional mechanical fasteners (e.g., without limitation, screws; rivets; bolts and nuts), as will be discussed in greater detail herein below.

Figure 4:
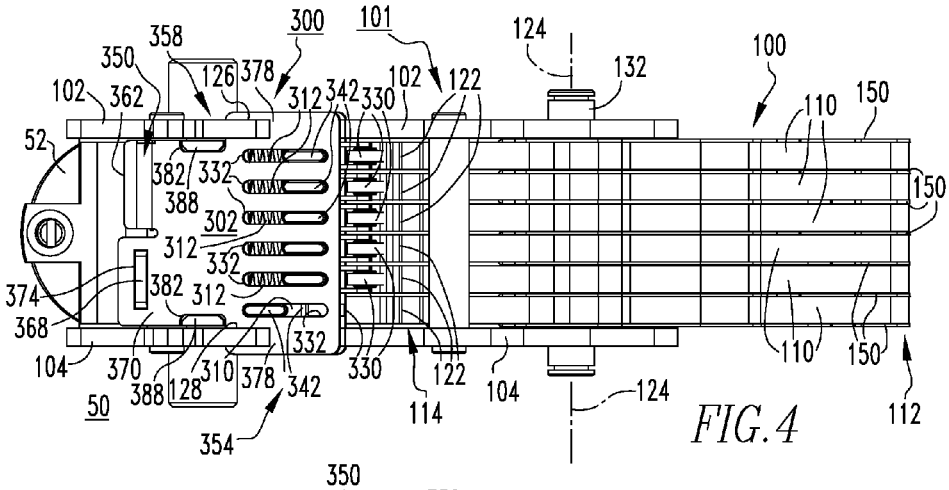
FIG. 4 is a top plan view of the conductor assembly of FIG. 2, including a self-contained contact spring assembly.
Figure 5:
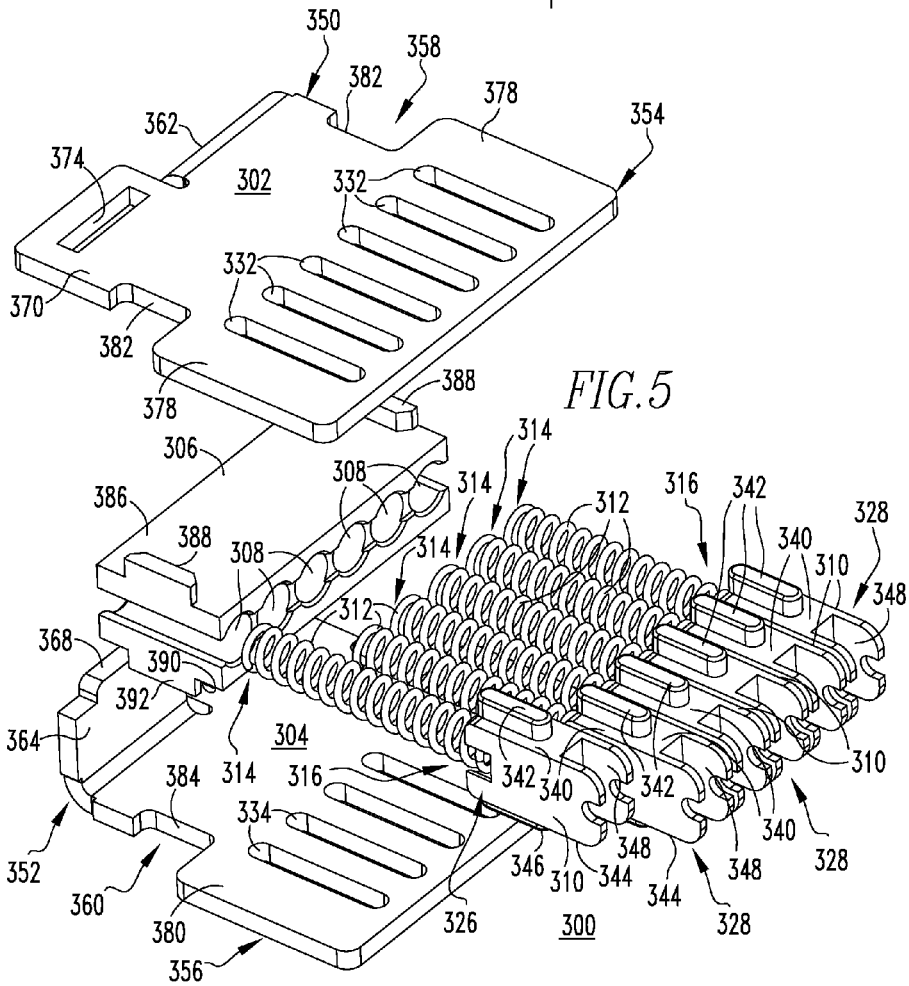
FIG. 5 is an exploded isometric view of the self-contained contact spring assembly of FIG. 4.

As shown in FIGS. 2 and 5, the example contact spring assembly 300 includes six springs 312 which are received in six corresponding spring thru holes 308 of the spring guide 306. The thru holes 308 (best shown in FIG. 5) extend completely through the spring guide 306, in order to receive the first ends 314 of the springs 312. As previously discussed, the second ends 316 of the springs 312 are coupled to individual sliders 310. Each slider 310 includes a first end 326 coupled to the second end 316 of a corresponding one of the springs 312, and a second end 328 comprising a cam element such as the rollers 330, best shown in FIGS. 2 and 4. Each of the cam elements 330 (FIGS. 2 and 4) is structured to engage and move a corresponding one of the movable contact arms 110 of the movable contact assembly 100.

Figure 6A:
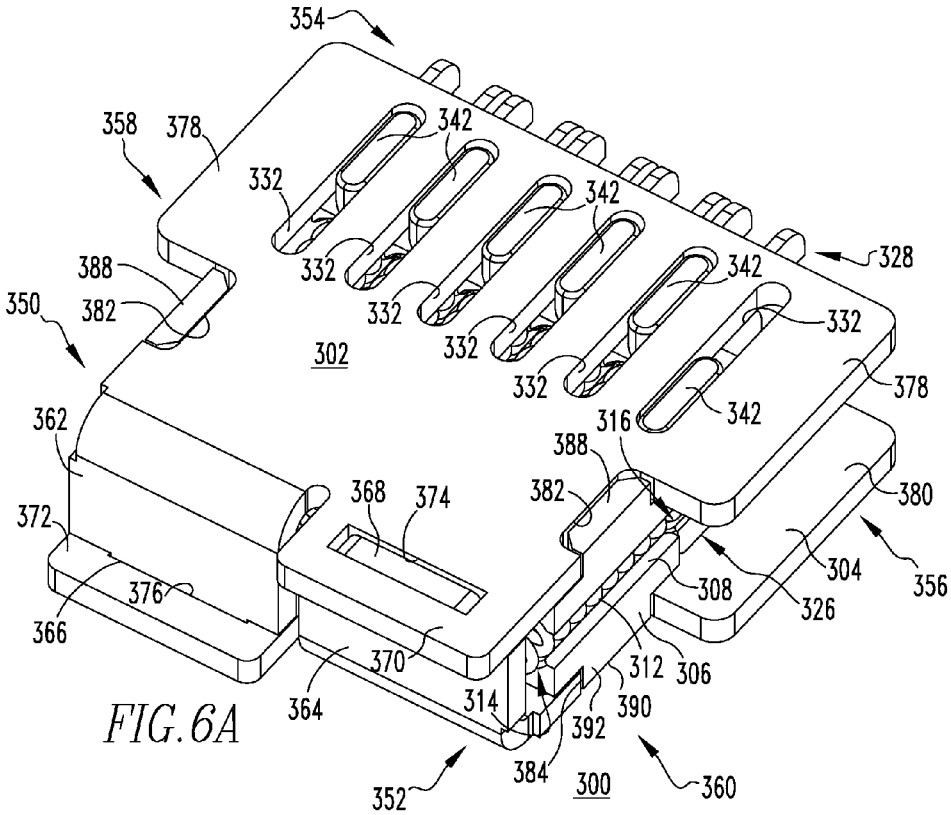
FIG. 6A is an assembled top isometric view of the self-contained contact spring assembly of FIG. 5.
Figure 6B:
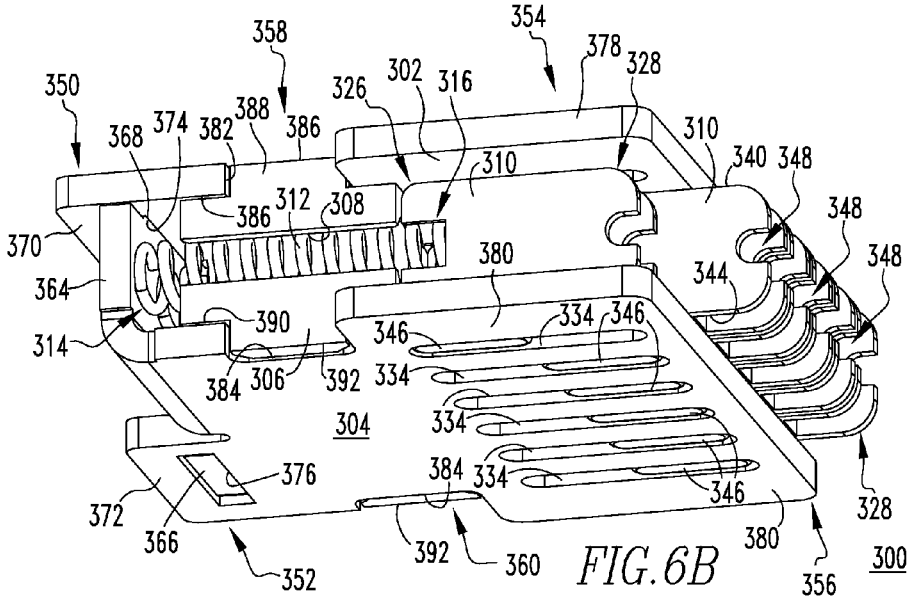
FIG. 6B is an assembled bottom isometric view of the self-contained contact spring assembly of FIG. 5.

Referring to FIGS. 5, 6A and 6B, the first and second contact spring housing members 302,304 of the contact spring assembly 300 each include a plurality of elongated guide slots 332,334 for receiving first and second protrusions 342,346 on the first and second sides 340,344 of each slider 310. Specifically, the first and second protrusions 342,346 engage an opposing pair of the elongated guide slots 332,334 of the first and second spring housing members 302,304, respectively, in order to guide the slider 310 and cam element 330 (FIGS. 2 and 4) towards engagement with the corresponding movable contact arm 110 (FIGS. 2 and 4). For example, in FIG. 4, five of the cam elements 330 are extended and engaging the second ends 114 of corresponding movable contact arms 110 of the movable contact assembly 100. The sixth cam element 330 is retracted, as indicated by the position of the first protrusion 342 of slider 310 within the first guide slot 332 of the first contact spring housing member 302. Accordingly, it will be appreciated that the cam elements 330 (FIGS. 2 and 4) of the contact spring assembly 300 in accordance with embodiments of the invention individually engage and bias a corresponding movable contact arm 110 (FIGS. 2 and 4) independent from the remainder of the cam elements 330 (FIGS. 2 and 4) of the contact spring assembly 300. It will be appreciated that the cam elements 330 can comprise any known or suitable bearing element, such as the small wheel 330 shown in FIG. 2, which is pivotably disposed within a recess 348 at the second end 328 of slider 310.

As previously noted, the contact spring assembly 300 is secured together and to the carrier assembly 101 (FIG. 2), without requiring the use of separate mechanical fasteners. More specifically, as best shown in FIGS. 5, 6A and 6B, the first and second contact spring housing members 302,304 each include at least one protrusion 366,368 and at least one aperture 374,376, wherein the first and second contact spring housing members 302,304 are positioned in order that the protrusion 366,368 of one of the first and second contact spring carrier members 302,304 engages the aperture 374, 376 of the other of the first and second contact spring carrier member 302,304, respectively, thereby securing the contact spring assembly 300 together. More specifically, the first and second contact spring housing members 302,304 each include a first end 350,352 and a second end 354,356, respectively. The first end 350,352 includes a folded tab 362,364 including the protrusion 366,368, and an unfolded tab 370, 372 having the aperture 374,376. The relationship between the first and second contact spring housing members 302,304 which, as previously discussed, are substantially identical, can best be appreciated with reference to the front and back isometric views of the contact spring assembly 300 shown in FIGS. 6A and 6B, respectively. Specifically, protrusion 366 of the folded tab 362 of the first end 350 of first contact spring housing member 302 engages the aperture 376 of the unfolded tab 372 of the first end 352 of second contact spring housing member 304, and protrusion 368 of the folded tab 364 of the first end 352 of second contact spring housing member 304 engages the aperture 374 of the unfolded tab 370 of the first end 350 of first contact spring housing member 302.

The second ends 354,356 of the first and second contact spring housing members 302,304 each comprise a pair of lateral protrusions 378,380 which, as best shown in FIGS. 2 and 4, are structured to engage corresponding slots 126,128 in the first and second carrier members 102,104 of the carrier assembly 101 of movable contact assembly 100. More specifically, the pair of lateral protrusions 378,380 of the second end 354,356 of one of the first and second contact spring housing members 302,304 engages corresponding slots 126, 128 in the first and second carrier members 102,104, respectively, of the carrier assembly 101, thereby securely coupling the contact spring assembly 300 to the movable contact assembly 100, without the use of separate mechanical fasteners.

The first and second contact spring housing members 302, 304 also include an intermediate portion 358,360 having a pair of recesses 382,384, respectively. The recesses 382,384 are engaged by corresponding first and second pairs of protrusions 388,392 on the first and second sides 386,390, respectively, of the spring guide 306.

As shown in FIGS. 1, 2, and 4, the movable contact arms 110 of the movable contact assembly 100 have an axis of a rotation 124. The axis of a rotation 124 extends generally perpendicularly with respect to the first and second carrier members 102,104 of the carrier assembly 101. More specifically, the movable contact arms 110 pivot clockwise and counterclockwise (from the perspective of FIGS. 1 and 2) about a pivot pin 132, which extends through a corresponding aperture 134 (FIG. 2) in each of the movable contact arms 110. The contact spring assembly 300 is coupled to the movable contact assembly 100, in the manner previously discussed, at a location which is above and behind the axis of rotation 124. This location, which is proximate the second ends 114 of the movable contact arms 110 of the movable contact assembly 100, provides the springs 312 of the contact spring assembly 300 with a mechanical advantage by placing them at a location (e.g., above and behind) which facilitates pivotal movement of the movable contact arms 110 about the aforementioned axis of a rotation 124. More specifically, the second end 114 of each movable contact arm 110 includes a cam profile 122 (FIGS. 2-4). In operation, the roller cam element 330 (FIGS. 2-4) of each slider 310 (FIGS. 2, 4, 5, 6A and 6B) of the contact spring assembly 300 (FIGS. 1, 2, 4, 5, 6A and 6B) engages the cam profile 122 of a corresponding one of the movable contact arms 110. In turn, as shown in FIG. 3, the roller cam element 330 (shown in phantom line drawing in simplified form in FIG. 3) rolls along the cam profile 122 in the direction generally indicated by arrow 136 of FIG. 3 as it biases the second end 114 of the movable contact arm 110 in the direction generally indicated by arrow 138 of FIG. 3, causing the movable contact arm 110 to pivot clockwise (from the perspective of FIG. 3) about axis of rotation 124 as generally indicated by arrow 140 of FIG. 3. In this manner, movable electrical contact 130 of the movable contact arm 110 is pivoted toward electrical contact with stationary electrical contact 12 of the stationary contact assembly 10. It will be appreciated that the cam profile 122 could have any known or suitable shape in order to provide the desired movable contact arm 110 motion.

The example stationary contact assembly 10, which is shown in phantom line drawing in simplified form in FIG. 3, includes a first contact portion 14 which is engaged by movable electrical contact 130 on movable contact arm 110, as shown. It will, however, be appreciated that the stationary contact assembly 10 could have any known or suitable alternative configuration. For example and without limitation, it could further include a second contact portion 16, as shown in phantom line drawing in simplified form in FIG. 3. It will also be appreciated that the first end 112 of the movable contact arm 110 could include, for example, a toe portion 106 and a heel portion 108, with the movable electrical contact 130 being mounted on the heel portion 108, as shown. The movable electrical contact 130 at or about the heel portion 108 is movable into and out of electrical contact with the stationary electrical contact 12 of first contact portion 14 of the stationary contact assembly 10, and the toe portion 106 is movable into (not shown) and out of (as shown) electrical contact with the second contact portion 16 of the stationary contact assembly 10. This movable and stationary electrical contact interaction is commonly referred to in the art as a "heel-toe" contact configuration, and is generally well known. Thus, the contact spring assembly 300 facilitates movement of the movable contact assembly 100 which is controlled by the circuit breaker operating mechanism (shown in simplified form in FIG. 1), in any suitable well known manner.

Referring to FIGS. 1 and 7-11, a pivot assembly 400 for the carrier assemblies 101 (FIGS. 1 and 9) of the low-voltage circuit breaker 2 (FIGS. 1, 9 and 10) is shown. The pivot assembly 400 comprises a plurality of pivot members 402, 404 which are separate independent components from the circuit breaker housing 3 (FIGS. 1 and 9-11). The pivot member 402,404 are structured to be clam-shelled between the molded cover 4 (FIGS. 1 and 9-10) and the molded base 5 (FIGS. 1, 9 and 10) of the circuit breaker housing 3, in order to improve the accuracy with which the carrier assembly 101 and components thereof (e.g., without limitation, movable contact assembly 100) are mounted within the circuit breaker 2.

Figure 9:
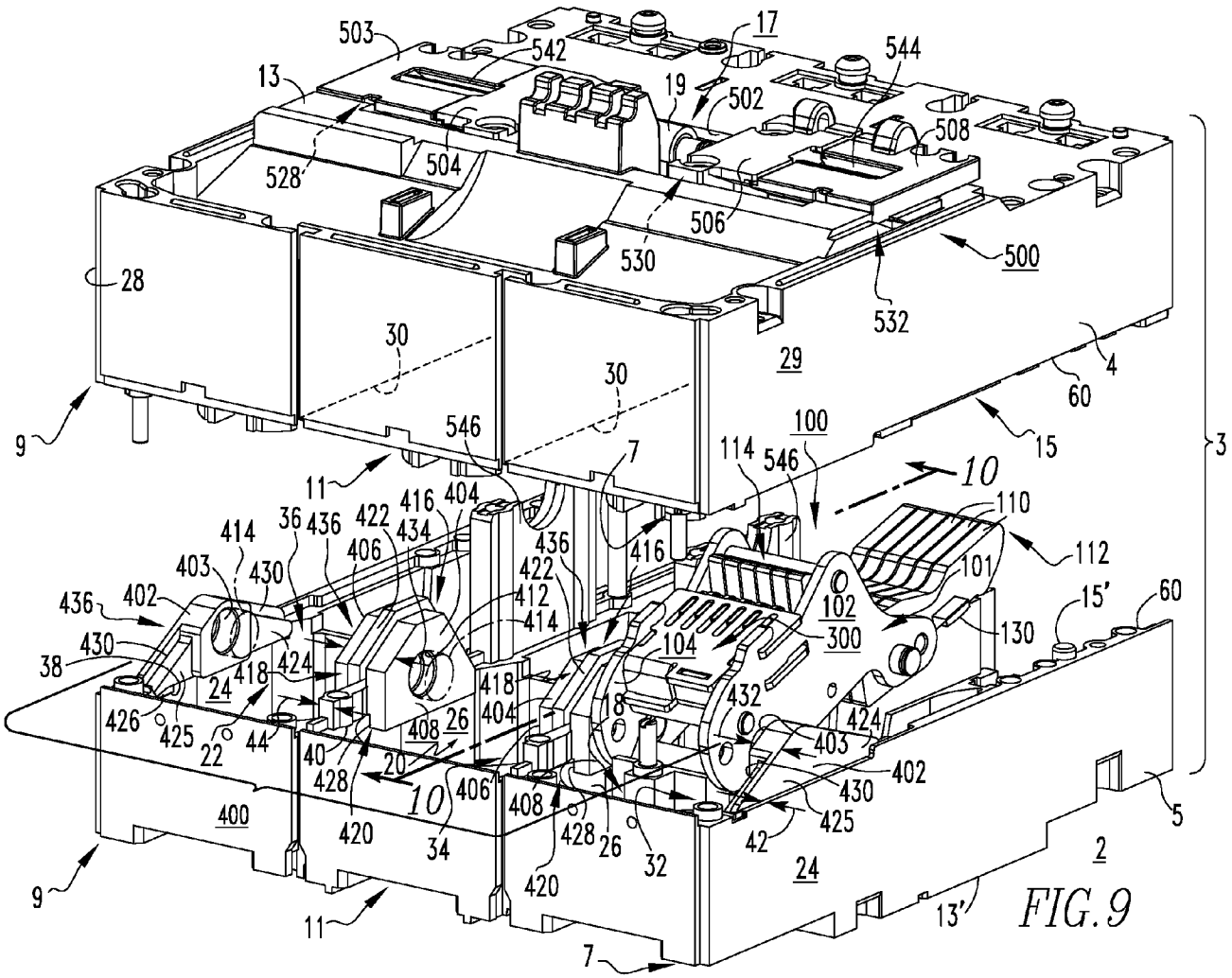
FIG. 9 is a partially assembled isometric view of the low-voltage circuit breaker and integral pole shaft bearing assembly therefor, of FIG. 1.

As best shown in FIG. 9, each of the pivot members 402, 404 includes an aperture 403,408,412 structured to receive a suitable pivot 158 of the carrier assembly 101 (FIG. 2) in order that it is pivotably coupled between a corresponding pair of the pivot members, such as 402,404, as shown. The pivot 158 may comprise any suitable pivot such as, for example and without limitation, at least one pivot pin, such as the first and second pivot pins 160,162 extending outwardly, generally perpendicularly from the first and second carrier members 102,104 of the carrier assembly 101 in FIG. 4.

Figure 7:
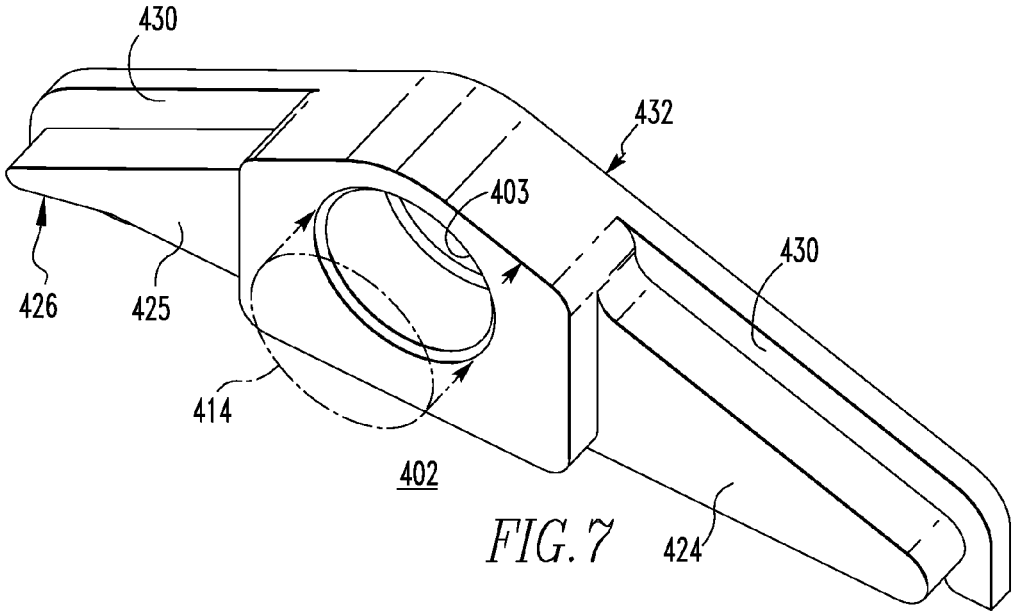
FIG. 7 is an isometric view of one component of the independent carrier assembly of FIG. 1.
Figure 8:
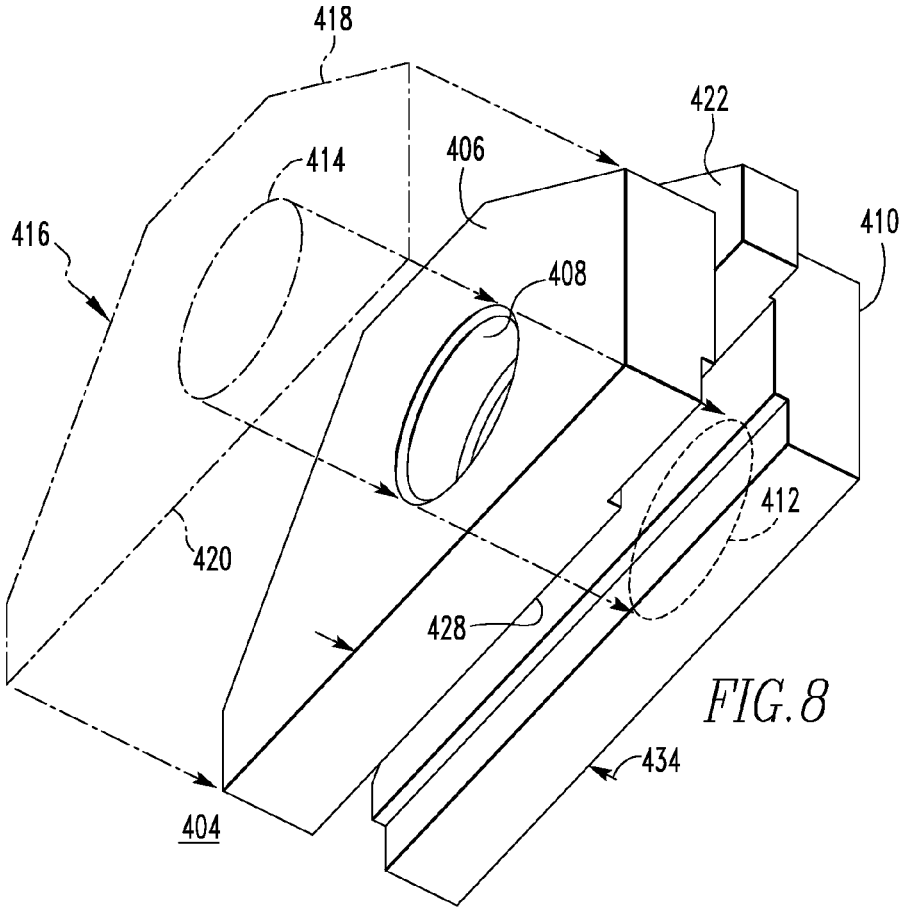
FIG. 8 is an isometric view of another component of the independent carrier assembly of FIG. 1.
Figure 10:
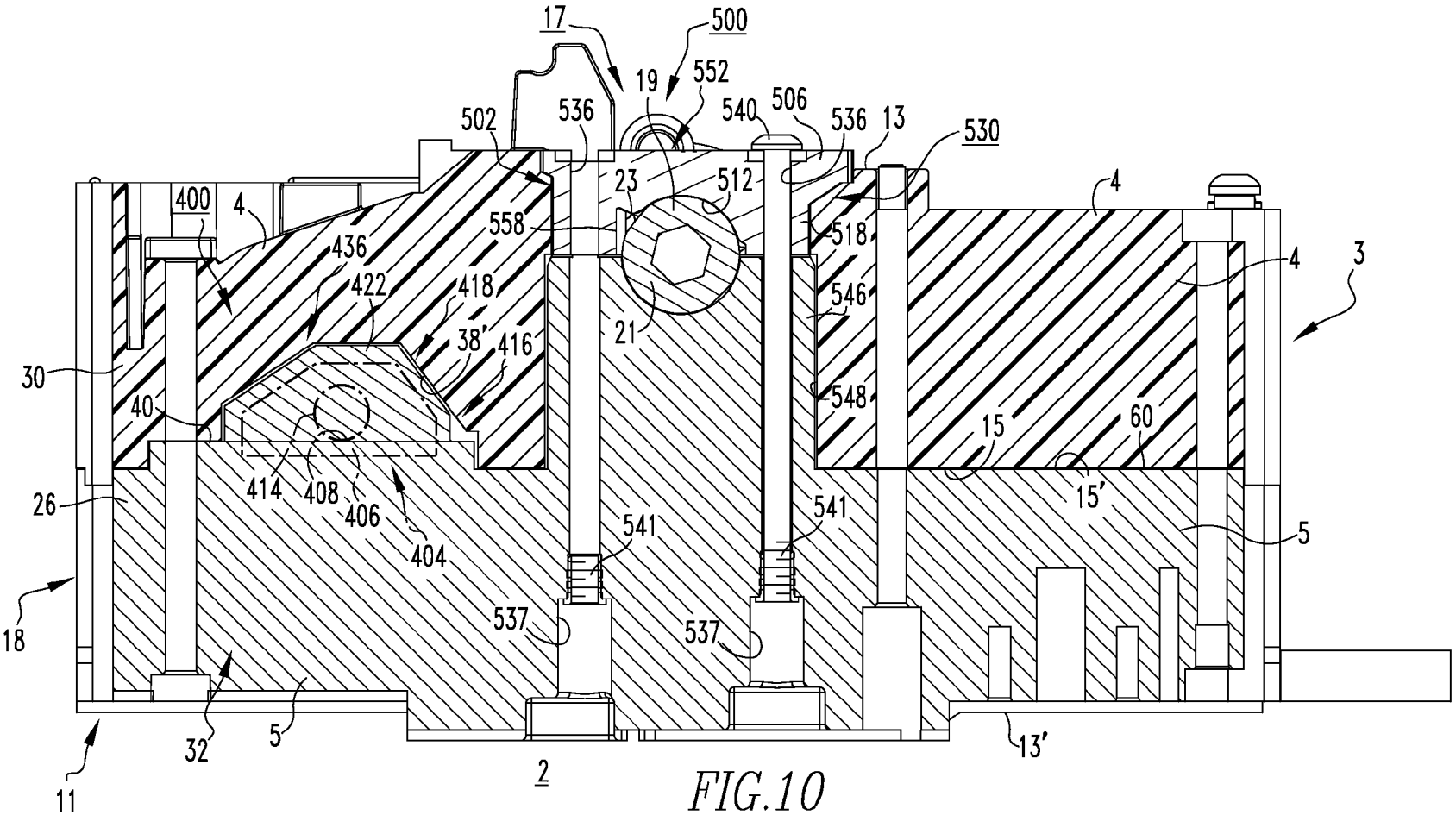
FIG. 10 is an assembled side elevational cross-sectional view of the low-voltage circuit breaker and integral pole shaft bearing assembly therefor, of FIG. 1.

FIGS. 7 and 8 respectively show the two types of pivot members 402 and 404 which comprise the example pivot assembly 400 (FIGS. 1, 9 and 10). More specifically, each of the one-piece molded pivot members 402,404 includes the aperture 403 (FIG. 7), 408 (FIG. 8), 412 (shown in hidden line drawing in FIGS. 8 and 10; see also FIG. 9) which is a substantially circular pivot recess 403 (FIG. 7), 408 (FIG. 8), 412 (shown in hidden line drawing in FIGS. 8 and 10; see also FIG. 9) having a full, continuous circumference 414.

End pivot member 402 of FIG. 7 includes a pair of lateral extensions 424,425 which extend outwardly from the pivot recess 403. In the example shown and described herein, at least one of the lateral extensions 424,425 includes at least one protrusion, such as the single tab 426 (best shown in FIG. 7) extending generally perpendicularly from lateral extension 425 of the pivot member 402. Each of the end pivot members 402 in the example shown and described, also includes at least one cut-out portion, such as, for example and without limitation, the pair of cut-out portions 430 in each of the lateral extensions 424,425 of the example end pivot member 402, shown. Each end pivot member 402 also has a width 432 which, as will be discussed hereinbelow, is equal to or greater than the width of the walls 24,26,28,30 (FIGS. 1 and 9) of the circuit breaker housing 3 (FIG. 1, and FIGS. 9-11). It will, however, be appreciated that the end pivot members 402 of the pivot assembly 400 (FIGS. 1, 9, and 10) could comprise any known or suitable alternative configuration and number of recesses and protrusions other than those shown and described herein, without departing from the scope of the invention. For example and without limitation, the pivot members 402 could alternatively have a combination (not shown) of protrusions but no recesses, or a combination (not shown) of recesses but no protrusions.

FIG. 8 shows an intermediate pivot member 404 of the pivot assembly 400 (FIGS. 1, 9, and 10). Each of the intermediate pivot members 404 has a perimeter 416 with at least one protrusion such as, for example, rib 422, which extends outwardly from a first portion 418 of the perimeter 416, and at least one recess such as, for example, elongated recess 428, within a second portion 420 of the perimeter 416. The rib 422 and elongated recess 428, like the aforementioned tab 426 and cut-out portions 430 of end pivot member 402 discussed in connection with FIG. 7, function to secure the pivot member 404 between the molded cover 4 and molded base 5 of the circuit breaker housing 3, as will be discussed in greater detail hereinbelow, for example with respect to FIG. 10. Like end pivot member 402, intermediate pivot member 404 is a one-piece molded member having a first pivot recess 408 in the first side 406 thereof, wherein the first pivot recess 408 has a full, continuous diameter 414. However, unlike end pivot member 402, each of the intermediate pivot members 404 further includes a second side 410 having a second pivot recess 412 (see, for example, FIG. 9). In this manner, in operation, each intermediate pivot member 404 receives and pivotably secures the pivot members 158 (FIG. 1) of two different carrier assemblies 101 (one carrier assembly 101 is shown in FIG. 1, for ease of illustration), one on the first side 406 and the other on the second side 410 of the intermediate pivot member 404.

At least one of the protrusions 422,426 of the respective pivot members 404,402 is structured to engage one of the molded cover 4 and the molded base 5 of the circuit breaker housing 3, and at least one of the cut-out portions 428,430 of the respective pivot members 404,402 is structured to engage the other of the molded cover 4 and molded base 5 in order to clam-shell the pivot members 402,404 therebetween, as previously discussed.

As employed herein, the term "clam-shell" refer to the nature in which the pivot members 402,404 are secured (e.g., sandwiched) between the molded cover 4 and molded base 5 of the circuit breaker housing 3, without requiring the use of separate fasteners. More specifically, as shown in FIG. 9, the circuit breaker 2 has a plurality of poles 18,20,22, and includes a carrier assembly 101 for each of these poles (one carrier assembly 101 is shown for simplicity of illustration). The circuit breaker housing 3 comprises a plurality of substantially vertical walls 24,26 and 28,30 molded in the molded base 5 and molded cover 4, respectively, of the circuit breaker housing 3. When the molded cover 4 and molded base 5 are assembled, as shown in FIG. 10, each of the substantially vertically walls 24,26 of the molded base 5 generally aligns with a corresponding one of the substantially vertical walls 28,30 of the molded cover 4 to form a plurality of separate cavities 32,34,36 for the poles 18,20,22 of the circuit breaker 2. Each of the aforementioned pivot members 402, 404 of the pivot assembly 400 is clam-shelled between the corresponding pair of substantially vertical walls 24,26 of the molded base 5 and the substantially vertical walls 28,30 of the molded cover 4, thereby providing substantially unobstructed access to the separate cavities 32,34,36 within the circuit breaker housing 3. In this manner, the pivot assembly 400 enables a circuit breaker housing 3 to accommodate a wide variety of circuit breaker component designs. For example and without limitation, it is the clam-shelled pivot assembly design which, in large part, enables the use of the solid conductor 52 of the conductor assembly 50, previously discussed in connection with FIGS. 1-3, and provides space to receive additional components such as, for example and without limitation, a sensor (not shown).

Figure 11:
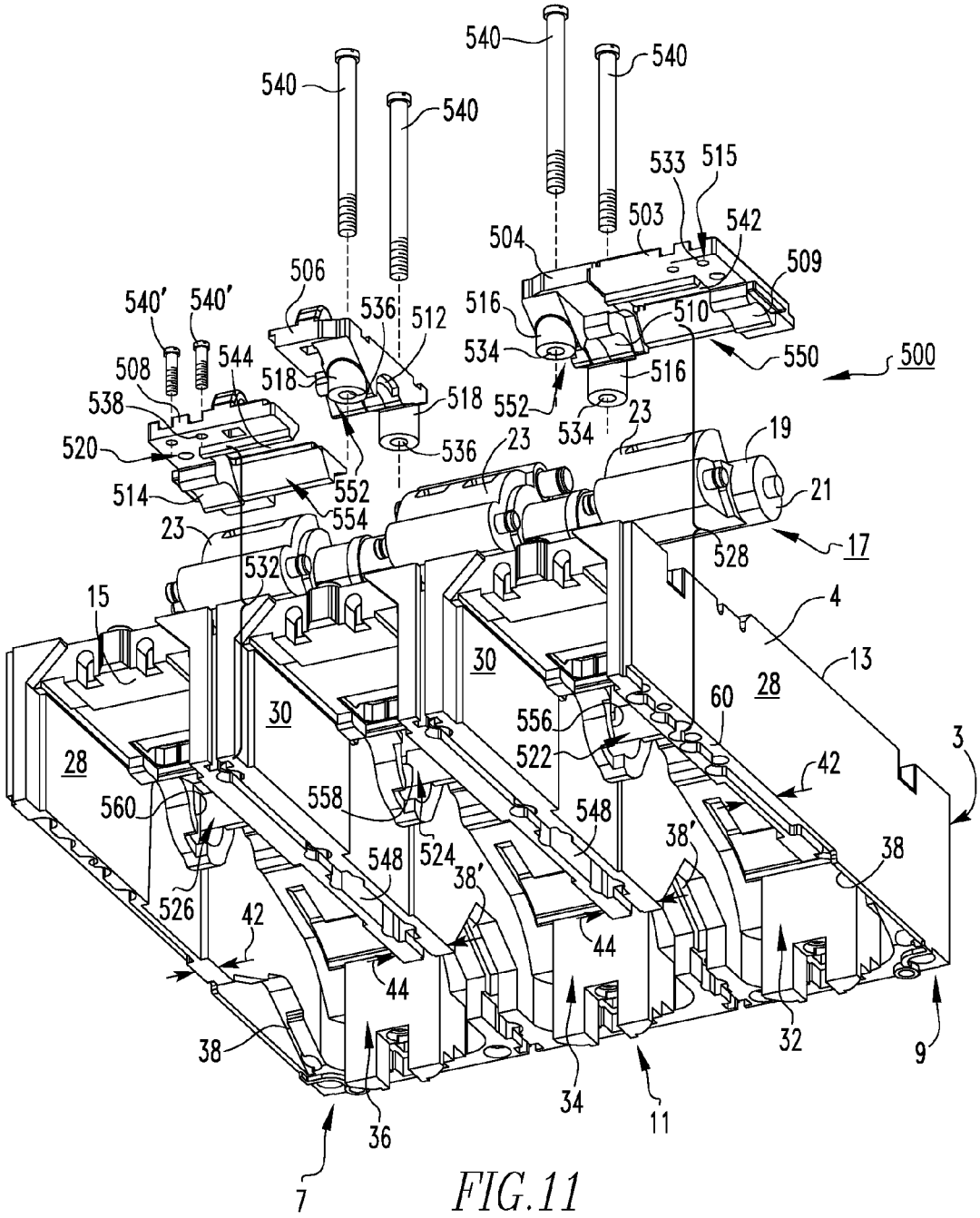
FIG. 11 is an isometric view of the underside of the molded cover of the low-voltage circuit breaker and a portion of the integral pole shaft bearing assembly therefor, of FIG. 1.

Continuing to refer to FIG. 9, the pivot assembly 400 for the three-pole low-voltage circuit 2 includes four pivot members 402,404, a pair of the aforementioned end pivot members 402 disposed at or about the first and second sides 7,9 of the circuit breaker housing 3, and a pair of the aforementioned intermediate pivot members 404 disposed between the end pivot members 402 at an intermediate portion 11 of the circuit breaker housing 3, as shown. More specifically, the tab 426 of each end pivot member 402 engages a corresponding recess 38 (best shown in FIGS. 1 and 9) of the molded base 5 of the circuit breaker housing 3 and the cut-out portions 430 and lateral extensions 424,425 of each end pivot member 402 are received within a corresponding recess 38 in the molded cover 4 of the circuit breaker housing 3, as best shown in FIG. 11, to clam-shell the end pivot members 402 between the molded cover 4 and molded base 5 of the circuit breaker housing 3, as previously discussed. Each intermediate pivot member 404 is similarly clam-shelled by the rib 422 of the intermediate pivot member 404 engaging a corresponding recess 38' of the molded cover 4 of the circuit breaker housing 3, as best shown in FIGS. 10 and 11, and the elongated recess 428 of the intermediate pivot member 404 receiving the corresponding protrusion 40 (e.g., without limitation, portion 40 of substantially vertical wall 26) of the molded base 5 of the circuit breaker housing 3.

In addition to the aforementioned advantages (e.g., without limitation, accommodation of manufacturing tolerance discrepancies; improved alignment between circuit breaker components), the pivot members 402,404 of the pivot assembly 400 also serve to provide a superior dielectric barrier 436 (FIGS. 9 and 10) between poles 18,20,22 (FIG. 9) of the circuit breaker 2, in order to electrically isolate one pole 18,20,22 from another. This advantage is afforded both by the aforementioned protrusion (e.g., rib 422) and recess (e.g., recess 38') closely fitting clam-shelled structure of the pivot assembly 400, which can best be appreciated with reference to the cross-sectional view of FIG. 10, and also to the fact that the first widths 432 (best shown in FIG. 7), 434 (best shown in FIG. 8) of the end pivot members 402 and intermediate pivot members 404 are greater than the second widths 42,44 (FIG. 9) of the walls 24,26 (FIG. 9), respectively, of the circuit breaker housing 3 (FIG. 9). Thus, it will be appreciated that the pivot members 402 are separate pieces, the increased widths 432,434 of which provide superior mechanical bearing support while simultaneously permitting widths 42,44 of the walls 24,26, for example, to be thinner, thereby providing increased interior space.

FIGS. 1 and 9-12 show another feature of the example low-voltage circuit breaker 2 (FIGS. 1, 9 and 10) which is structured to address and overcome the aforementioned manufacturing tolerance discrepancy and alignment issues among and between circuit breaker components (e.g., without limitation, stationary contact assembly; movable contact assembly; carrier assembly; operating mechanism) which result, for example, between a first circuit component (e.g., without limitation, stationary contact assembly; movable contact assembly; carrier assembly; operating mechanism) which is mounted to a first portion or section (e.g., without limitation, exterior side 13' of molded base 5 of FIG. 1) of one part (e.g., without limitation molded base 5) of the circuit breaker housing 3 and coupled to at least one other component (e.g., without limitation, stationary contact assembly; movable contact assembly; carrier assembly; operating mechanism) mounted to another portion or section (e.g., without limitation, interior side 15' of molded base 5 of FIG. 1) of the same part (e.g., without limitation, molded base 5). In other words, such issues result as a consequence of the parting line, as defined herein, of the individual component. It will, however, be appreciated that they also occur across the mating line, as defined herein, between separate components of the breaker 2 such as, for example and without limitation, the mating line between the first half (e.g., molded cover 4 of FIG. 1) of the circuit breaker housing (e.g., housing 3 of FIG. 1) and on the second half (e.g., molded base 5 of FIG. 1) of the housing (e.g., housing 3 of FIG. 1). Specifically, a bearing assembly 500 is employed which pivotably supports the pole shaft 19 of the circuit breaker operating mechanism 17 substantially independent of the mating line between the molded cover 4 and molded base 5 of the circuit breaker housing 3, and of the parting line(s) of any and all intermediate part(s) interposed therebetween. The bearing assembly 500 also pivotably couples and supports the pole shaft 19 on the same side of the parting line of the molded base 5 as the stationary contact assembly 10 of the circuit breaker 2. Accordingly, misalignment across the parting line and/or mating the line 60, which is/are prevalent in the known prior art, is substantially eliminated. In the example low-voltage circuit breaker 2 of FIG. 1, the pole shaft 19 is disposed substantially entirely outside of the molded cover 4 while being substantially supported on the molded base 5 of the circuit breaker housing 3. Such configuration of the pole shaft 19 is made possible by the bearing assembly 500 in accordance with embodiments of the invention, which will now be discussed. It will be appreciated that not all of the components of the bearing assembly 500 are shown in each of FIGS. 1 and 9-12. In particular, several components are not shown in FIGS. 9 and 10 which respectively show the bearing assembly 500 assembled, and a cross-section of a portion of the bearing assembly 500.

Figure 12:
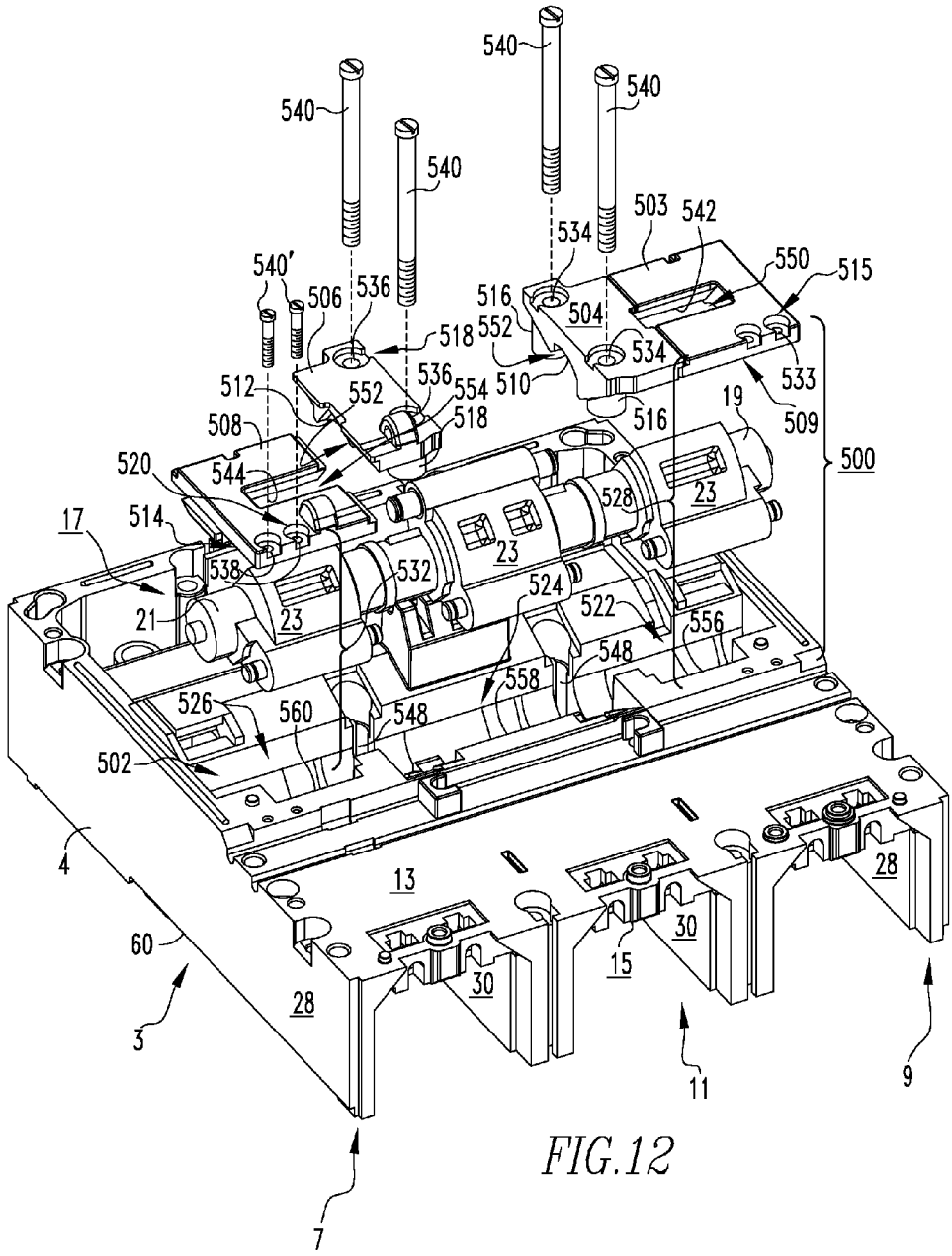
FIG. 12 is an isometric view of the top side of the molded cover of the low-voltage circuit breaker and a portion of the integral pole shaft bearing assembly therefor, of FIG. 1.

The bearing assembly 500 includes a number of primary bearings 530,531, (FIGS. 1 and 10), an integral bearing section 502 (not expressly shown in FIG. 9; best shown in FIG. 12), and at least one bearing cover member 503,504,506,508 (only one cover member 506 is shown in the cross-sectional view of FIG. 10). Each cover member 503,504,506,508 includes a bearing surface 509,510,512,514 and a fastening portion 515,516,518,520. The fastening portions 515,516, 518,520 are structured to couple the bearing cover members 503,504,506,508 to the molded cover 4 in order that the pole shaft 19 of the operating mechanism 17 is pivotably disposed between the integral bearing section 502 and the bearing surfaces 509,510,512,514 of the bearing cover members 503, 504,506,508 on the exterior side 13 of the molded cover 4, as best shown in FIGS. 9 and 12. More specifically, the integral bearing section 502 is "integral" in the sense that it comprises a plurality of molded portions 522,524,526 which are molded directly into the exterior surface 13 of the molded cover 4, as best shown in FIG. 12. It will, however, be appreciated that the pole shaft 19 could alternatively be pivotably disposed, for example and without limitation, on the exterior side 13' of the molded base 5 of the circuit breaker housing 3, without departing from the scope of the invention.

The molded portions 522,524,526 of the integral bearing section 502 generally comprise a number of molded first semi-circles 522,526 which are structured to receive the generally cylindrical shaft 21 of pole shaft 19, thereby forming the first part of a secondary pole shaft bearing 528,532. The second part of the secondary pole shaft bearing (two secondary pole shaft bearings 528,532 are shown in the example bearing assembly 500 illustrated and described herein) is formed by the bearing surface 509,514 of a corresponding bearing cover member 503,508 each of which comprises a second semi-circle 509,514. When the fastening portion 515, 516,518,520 of each bearing cover member 503,504,506,508 is coupled to the molded cover 4 of housing 3, each first semi-circle 522,526 of integral bearing section 502 aligns with the second semi-circle 509,514 of a corresponding one of the bearing cover members 503,508, in order to form the secondary pole shaft bearings 528,532.

More importantly, the pole shaft 19 is pivotably supported by the primary bearings 530,531. Specifically, the example bearing assembly 500 includes two primary bearings 530,531 which provide the primary support for the pole shaft 19. The primary bearings 530,531, as will be discussed herein, pivotably couple and support the pole shaft 19 on the same side (e.g., interior side 15') of the parting line of the molded base 5 as the stationary contact assembly 10 of the circuit breaker 2. In this manner, the disadvantages (e.g., without limitation, misalignment) commonly associate with the parting line(s) of each individual component or group of components, and the mating line(s) between components, are eliminated because the relationship between the pole shaft 19 and stationary contact assembly 10 does not cross the parting line(s) and/or mating line(s). This relationship can be best appreciated with reference to the cross-sectional view of FIG. 10, which shows primary bearing 530, in detail.

The example bearing assembly 500 includes four bearing cover members 503,504,506,508, a first molded bearing cover 503, a second molded bearing cover 504, a third molded bearing cover 506, and a fourth molded bearing cover 508. It will, however, be appreciated that any known or suitable number of bearing cover members having any known or suitable configuration could alternatively be employed. For example and without limitation, a single-piece bearing cover member (not shown) could be used. The fastening portions 515,516,518,520 of the example first, second, third and fourth molded bearing cover members 503,504,506,508 respectively include at least one opening 533,534,536,538 and fasteners, such as the screws 540,540' which are shown. The screws 540,540' are inserted through the corresponding openings 533,534,536,538 and are tightened to secure the corresponding bearing cover members 503,504,506,508 to the exterior side 13 of the molded cover 4 of circuit breaker molded housing 3. It will, however, be appreciated that any known or suitable alternative fastening mechanism other than the example fasteners 540,540' shown and described herein, could be employed. The molded cover members 503,504, 506,508 and the remainder of the bearing assembly 500 are shown assembled in FIG. 9 (shown without fasteners 540, 540'; see also FIG. 10 showing fasteners 540).

As previously noted, the pole shaft 19 comprises a generally cylindrical shaft 21. The generally cylindrical shaft 21 includes a plurality of levers 23 extending generally outwardly therefrom, as shown in FIGS. 1 and 10-12. In order to accommodate movement of such levers 23, each of the bearing cover members 503,504,506,508 further includes a plurality of first molded passages 550,552,554 structured to permit pivoting of the pole shaft 19 and, in particular, levers 23 of the pole shaft 19. Likewise, the integral bearing section 502 includes a plurality of second molded passages 556,558,560 for receiving the levers 23 when the pole shaft 19 pivots. The example pole shaft 19 includes three levers 23 protruding outwardly from the generally cylindrical shaft 21. The three levers 23 are respectively accommodated by three first molded passages 550,552,554 in the first, second and third molded bearing cover members 504,506,508 and three corresponding second molded passages 556,558,560 in the integral bearing section 502 of the bearing assembly 500.

At least one of the bearing cover members 503,504,506, 508 additionally includes at least one aperture 542,544 for providing access to a portion of the pole shaft 19 from the exterior side 13 of the molded cover 4 when the bearing assembly 500 is assembled, as best shown in FIG. 9. In this manner, at least partial access to the pole shaft 19 is provided in order to, for example and without limitation, sense or view the position of the pole shaft 19, inspect, and/or maintain (e.g., without limitation, lubricate) the pole shaft 19 without requiring the entire bearing assembly 500 to be disassembled. Hence, because the bearing assembly 500 is substantially disposed on the exterior side 13 of the circuit breaker housing 3 and substantially entirely on one side of the mating line 60 of the circuit breaker housing 3, as opposed to being disposed at or about the mating line 60 between the molded cover 4 and molded base 5 of the housing 3, as is sometimes the case in the known prior art, the bearing assembly 500 and pole shaft 19 can be relatively easily accessed from the exterior side 13 of the housing 3 without having to entirely separate the molded cover 4 and molded base 5. The example bearing assembly 500 includes two apertures 542,544 in the first molded bearing cover member 503 and fourth molded bearing cover member 508, respectively, although it will be appreciated that any known or suitable number of apertures, or that no apertures whatsoever, could be employed without departing from the scope of the invention. It will also be appreciated that the apertures 542,544, in addition to serving the aforementioned access function for providing access to pole shaft 19, can also serve to further accommodate pivotable motion of the aforementioned levers 23 of the pole shaft 19.

As previously discussed, the example bearing assembly 500 includes two primary bearings 530,531. The first half of each primary bearing 530,531 (one primary bearing 530 is best shown in FIG. 10) comprises a molded extension 546 of the molded base 5 of the circuit breaker housing 3. Specifically, the molded cover 4 and molded base 5 each further include an interior side 15', 15 and, as discussed previously, substantially vertical walls 24,26,28,30 extend outwardly from the interior side 15',15 of the molded cover 4 and molded base 5, respectively. The molded extensions 546, two of which are shown in the example bearing assembly 500 of FIGS. 1 and 9, comprise molded extensions 546 of the substantially vertical walls 26 of the molded cover 4 (best shown in FIG. 10). As best shown in FIG. 10, the molded extension 546 is coupled to a corresponding one of the integral bearing cover members 506 of the bearing assembly 500 proximate a corresponding one of the molded portions (e.g., molded portion 524 of FIG. 10) thereof in order to support the pole shaft 19 of the operating mechanism 17. The bearing cover member 506, thus serves as the second half of the integral bearing 530.

A corresponding substantially vertical wall 30 of the molded cover 4 of housing 3 includes a molded recess 548 (best shown in FIG. 11) structured to receive the molded extension 546 of substantially vertical wall 26 of the molded base 5, as shown in FIG. 10, and the aforementioned fasteners 540 (one fastener 540 is shown in FIG. 10) are inserted through opening 536 of the bearing cover member 506 and into a corresponding opening 537 of the molded extension 546. The fastener 540 then engages a second fastening mechanism 541, such as, for example and without limitation, a threaded component (e.g., without limitation, a nut), and is tightened to secure the bearing assembly 500 together. It will, however, be appreciated that any other known or suitable fastening mechanism other than the pair of fastening components 540,541 which are shown, could be employed without departing from scope of the invention.

Accordingly, the bearing assembly 500 provides a cost effective mechanism for addressing and overcoming alignment issues with respect to different portions or sections of the same component(s) (e.g., across the parting line(s)) of the circuit breaker 2, and/or between the various separate components (e.g., across the mating line(s)) of the circuit breaker 2. The bearing assembly 500 also provides for relatively easy assembly and access of the circuit breaker pole shaft 19, for example, for inspection and/or maintenance, without requiring complete disassembly of the entire circuit breaker 2.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A bearing assembly for an electrical switching apparatus including a housing having a molded cover, a molded base a mating line between said molded cover and said molded base, and an exterior side, a stationary contact assembly disposed on one side of said mating line of said housing, a movable contact assembly, and an operating mechanism including a pole shaft for moving said movable contact assembly into and out of electrical contact with said stationary contact assembly, said bearing assembly comprising:

a number of primary bearings structured to pivotably support said pole shaft of said operating mechanism substantially independent of said mating line of said housing, said number of primary bearings being structured to couple said pole shaft to the same one of said molded cover of said housing and said molded base of said housing as said stationary contact assembly of said electrical switching apparatus;

an integral bearing section structured to pivotably couple said pole shaft of said operating mechanism to said housing of said electrical switching apparatus; and at least one bearing cover member including a bearing surface and a fastening portion structured to be coupled to the exterior side of said housing of said electrical switching apparatus, wherein when said fastening portion of said at least one bearing cover member is coupled to the exterior side of said housing, said pole shaft of said operating mechanism is pivotably disposed between said integral bearing section and said bearing surface of said at least one bearing cover member on the exterior side of said housing, and wherein said number of primary bearings, said integral bearing section and said at least one bearing cover member are structured to be fixedly disposed with respect to said housing.

2. The bearing assembly of claim 1 wherein said pole shaft of said operating mechanism is generally cylindrical in shape; and wherein said integral bearing section comprises a plurality of molded portions structured to be molded on the exterior side of said housing of said electrical switching apparatus in order to receive said generally cylindrical pole shaft.

3. The bearing assembly of claim 2 wherein said at least one bearing cover member is a plurality of bearing cover members; wherein said integral bearing section and a number of said bearing cover members combine to form a plurality of secondary pole shaft bearings; wherein each of said secondary pole shaft bearings has a first part and a second part; wherein said molded portions of said integral bearing section comprise the first part of one of said secondary pole shaft bearings; and wherein said bearing surface of each of said bearing cover members comprises the second part of said one of said secondary pole shaft bearings.

4. The bearing assembly of claim 3 wherein said molded portions of said integral bearing section comprise a plurality of molded first semi-circles; wherein said bearing surface of each of said bearing cover members comprises a second semi-circle; and wherein when said fastening portion of each of said bearing cover members is coupled to the exterior side of said housing of said electrical switching apparatus, each of said molded first semi-circles of said integral bearing section aligns with said second semi-circle of a corresponding one of said bearing cover members in order to form a corresponding one of said secondary pole shaft bearings.

5. The bearing assembly of claim 1 wherein said fastening portion of said at least one bearing cover member comprises at least one opening and at least one fastener;

and wherein a corresponding one of said at least one fastener is disposed in a corresponding one of said at least one opening of said fastening portion of said at least one bearing cover member and tightened, in order to secure each of said at least one bearing cover member to the exterior surface of said housing of said electrical switching apparatus.

6. The bearing assembly of claim 1 wherein said at least one bearing cover member comprises a first molded cover member, a second molded cover member, a third molded cover member, and a fourth molded cover member; and wherein at least one of said first molded cover member, said second molded cover member, said third molded cover member, and said fourth molded cover member, includes an aperture structured to provide access to a portion of said pole shaft of said operating mechanism from the exterior side of said housing of said electrical switching apparatus.

* * * * *